US007367066B1

(12) United States Patent
Reid

(10) Patent No.: US 7,367,066 B1
(45) Date of Patent: May 6, 2008

(54) PIVOTALLY ADJUSTABLE TOILET LID

(76) Inventor: Delroy A. Reid, 2511 Sunrise Ridge La., Jacksonville, FL (US) 32211

( * ) Notice: Subject to any disclaimer, the term of this patent is extended or adjusted under 35 U.S.C. 154(b) by 399 days.

(21) Appl. No.: 11/259,930

(22) Filed: Oct. 28, 2005

(51) Int. Cl.
*A47K 13/10* (2006.01)

(52) U.S. Cl. ..... 4/246.1

(58) Field of Classification Search ..... 4/246.1–246.5
See application file for complete search history.

(56) References Cited

U.S. PATENT DOCUMENTS

| | | | | |
|---|---|---|---|---|
| 1,511,533 | A | 10/1924 | Staszak | |
| 1,632,819 | A * | 6/1927 | Chastain | 4/246.5 |
| 1,792,811 | A | 2/1931 | Bustin | |
| 2,954,565 | A | 10/1960 | Miller | |
| 4,584,724 | A * | 4/1986 | Wilson | 4/246.5 |
| 5,075,906 | A | 12/1991 | Robbins | |
| D341,416 | S | 11/1993 | Blair | |
| 5,327,589 | A | 7/1994 | Rice | |
| 5,448,782 | A | 9/1995 | Ratajac | |
| 5,487,192 | A | 1/1996 | Hodges | |
| 5,875,498 | A | 3/1999 | Joseph | |
| 5,978,974 | A | 11/1999 | Mullen | |
| 6,112,335 | A * | 9/2000 | Gaston | 4/246.1 |
| 6,151,723 | A * | 11/2000 | MacAllister | 4/246.1 |
| 6,393,623 | B1 * | 5/2002 | Strickland, Jr. | 4/246.3 |
| 6,470,503 | B1 * | 10/2002 | Holmes | 4/246.1 |
| 6,615,412 | B1 | 9/2003 | Hammond | |
| 2002/0032924 | A1 * | 3/2002 | Shimada | 4/246.1 |
| 2004/0060104 | A1 | 4/2004 | Nishikawa et al. | |

* cited by examiner

*Primary Examiner*—Charles E. Phillips

(57) ABSTRACT

A pivotally adjustable toilet lid lifting apparatus, comprising a base with spring resisted pedal, the pedal operating a substantially semicircular adjustably positioned pivot arm, the pivot arm connected to an adjustably removable and reversible actuation arm, the actuation arm removably and slideably engaging a toilet lid, whereby pedal pressure lifts the toilet lid and release of the pressure provides lid closure. The actuation arm is removable and reversible to provide for using the invention on either side of a toilet.

18 Claims, 4 Drawing Sheets

PIVOTALLY ADJUSTABLE TOILET LID

BACKGROUND OF THE INVENTION

The conventional method of raising and lowering a toilet seat has always been less than desirable. The transference of germs, bacteria, and disease is increased by human contact with the toilet. Many have resorted to using feet, shoes, sticks, and other devices to prevent having to touch the toilet. Such means for raising and lowering a toilet lid are not always reasonable or effective. Many devices have been presented which will raise and lower a lid, but such devices are either too complex or require invasion of the toilet seat for mounting the devices. And, leverages provided by such devices are often incorrectly imposed. Grasping the lid back towards the lid hinge requires excessive leverage until the lid approaches a near vertical, at which time the force required to raise the lid is greatly diminished. Some devices have offered shock absorbing and cushioning efforts to try to counteract this design flaw.

Basic design and proper leverage application, therefore, have long been needed in an apparatus that will raise and lower a toilet seat.

FIELD OF THE INVENTION

The present invention relates to toilet accessories and more especially to a toilet lifting and lowering device.

SUMMARY OF THE INVENTION

The general purpose of the pivotally adjustable toilet lid lifting apparatus, described subsequently in greater detail, is to provide a pivotally adjustable toilet lid lifting apparatus which has many novel features that result in an improved pivotally adjustable toilet lid lifting apparatus which is not anticipated, rendered obvious, suggested, or even implied by prior art, either alone or in combination thereof.

To accomplish this, the invention comprises an apparatus that can be placed proximal to either side of a toilet. The invention comprises a base to which is hingedly attached a foot pedal. The foot pedal downward movement is resisted by at least one compression spring. The spring returns the pedal to an upward rest position when the foot pedal is not depressed. The toilet lid is thereby returned to a closed position when the pedal is released from foot pressure, thereby offering the further advantage of saving countless male/female relationships. The pedal is connected to a pivot arm that is substantially semicircular in shape.

The pivot arm shape provides a pivotal leverage advantage not known in most devices in the art and further not known without excess complexity. The pivot arm is adjustably connected to the stanchion of the base, whereby height positioning of the pivot arm is provided for. The actuation arm is removable and adjustable with regard to height in its attachment to the pivot arm. The invention is thereby fully adjustable to fit a great variety of toilets. The fork of the actuation arm fits loosely about the side of a toilet lid, thereby providing for lift without any frictional binding. Because the actuation arm is removable and reversible, the invention can be placed adjacent to either side of a toilet. By providing for lifting a toilet lid without touching it, the invention insures against the transmission of germs, disease, and dirt. The invention is thereby useful to users and to those involved in janitorial pursuits. The invention is also useful for children and for those who cannot lift a lid for whatever reason. The invention is made of a variety of materials in various examples. The invention is uniquely basic and offers leverage superiority to comparative devices.

Thus has been broadly outlined the more important features of the pivotally adjustable toilet lid lifting apparatus so that the detailed description thereof that follows may be better understood and in order that the present contribution to the art may be better appreciated.

Numerous objects, features and advantages of the pivotally adjustable toilet lid lifting apparatus will be readily apparent to those of ordinary skill in the art upon reading the following detailed description of presently preferred, but nonetheless illustrative, examples of the pivotally adjustable toilet lid lifting apparatus when taken in conjunction with the accompanying drawings.

In this respect, before explaining the current examples of the pivotally adjustable toilet lid lifting apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the pivotally adjustable toilet lid lifting apparatus. It is therefore important that the claims be regarded as including such equivalent constructions insofar as they do not depart from the spirit and scope of the present invention.

Objects of the pivotally adjustable toilet lid lifting apparatus, along with various novel features that characterize the invention are particularly pointed out in the claims forming a part of this disclosure. For better understanding of the pivotally adjustable toilet lid lifting apparatus, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the pivotally adjustable toilet lid lifting apparatus employing the principles and concepts of the present invention and generally designated by the reference number 10 will be described.

Figure 1:
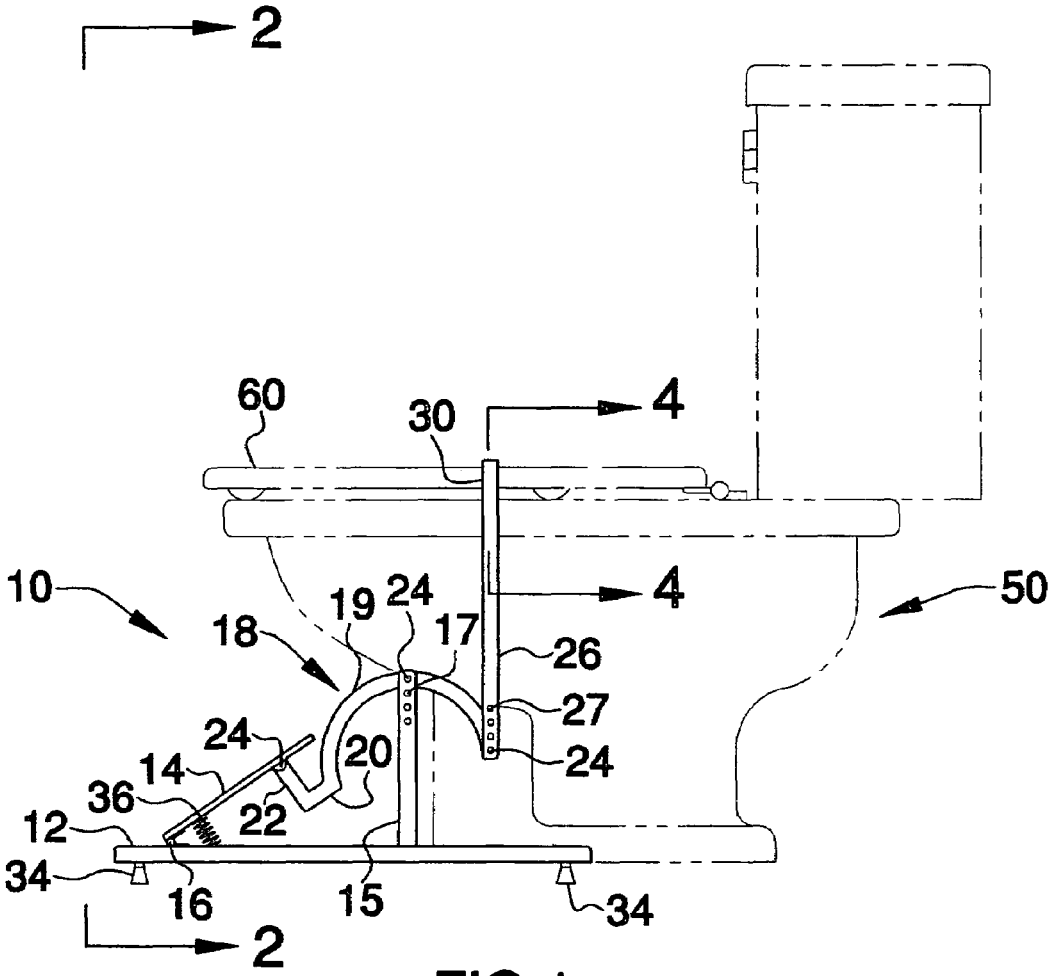
FIG. 1 is a side elevation of the invention in use with a toilet.
Figure 2:
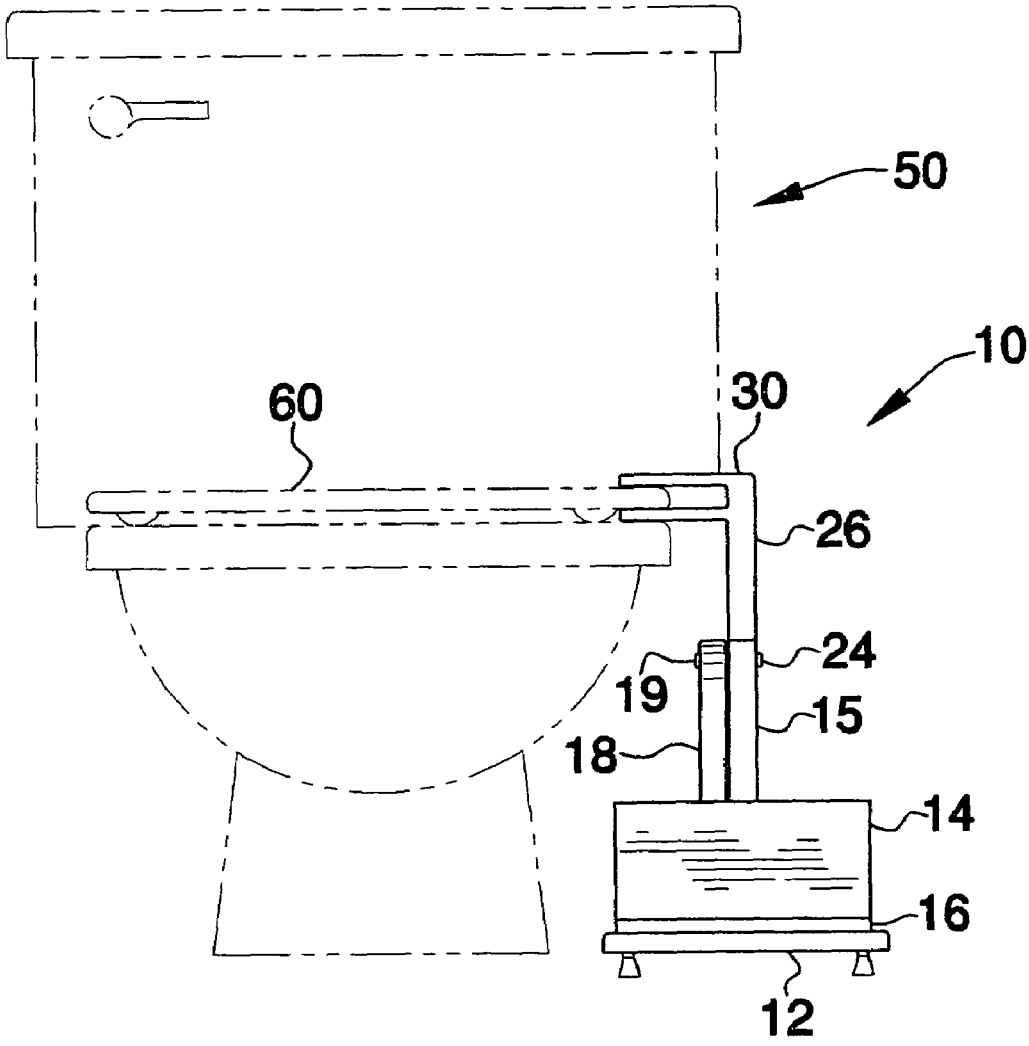
FIG. 2 is a front elevation view of the invention of FIG. 1, taken along the line 2-2, the lid of the toilet in the closed position.
Figure 3:
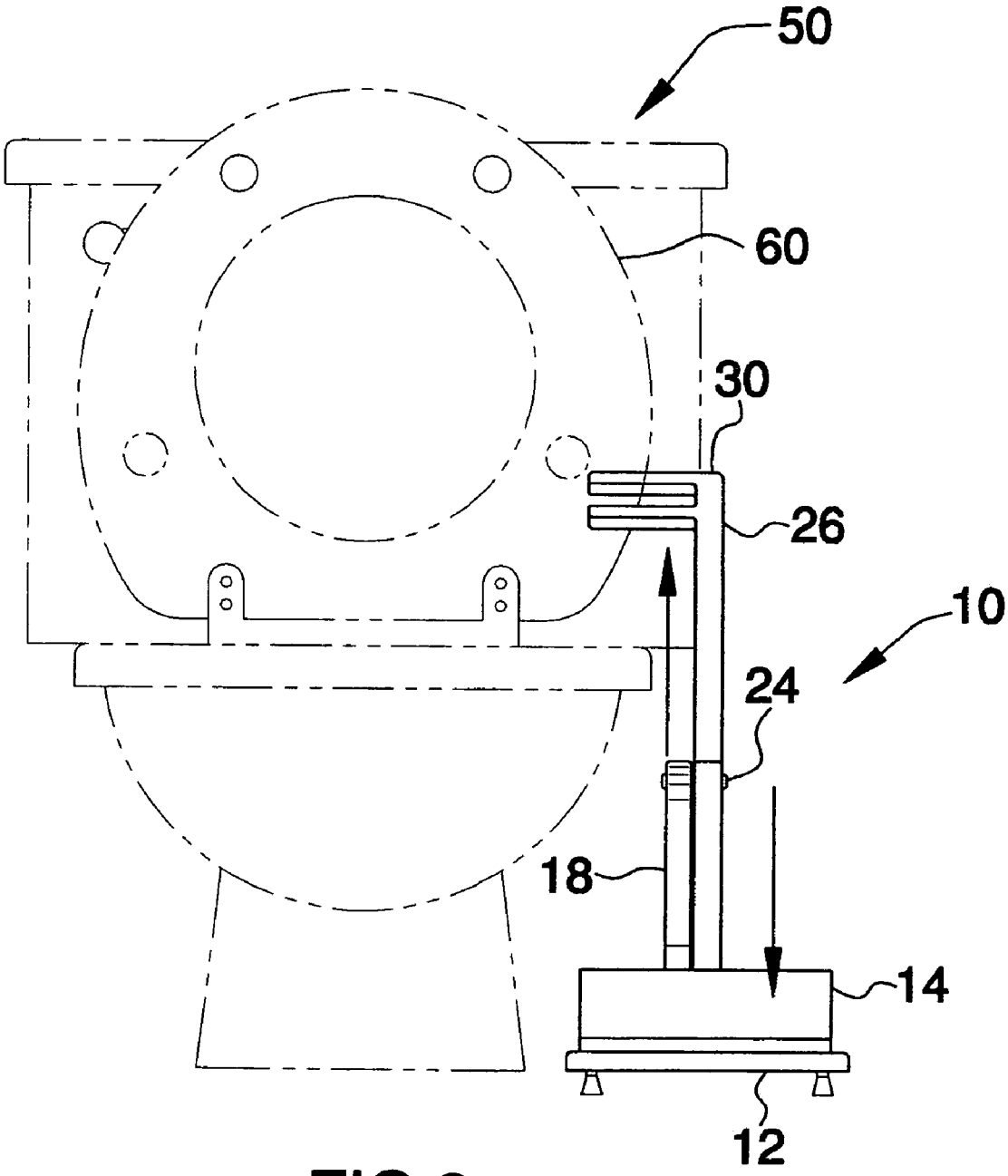
FIG. 3 is a front elevation of the invention in use with the toilet, the lid in the lifted position.
Figure 4:
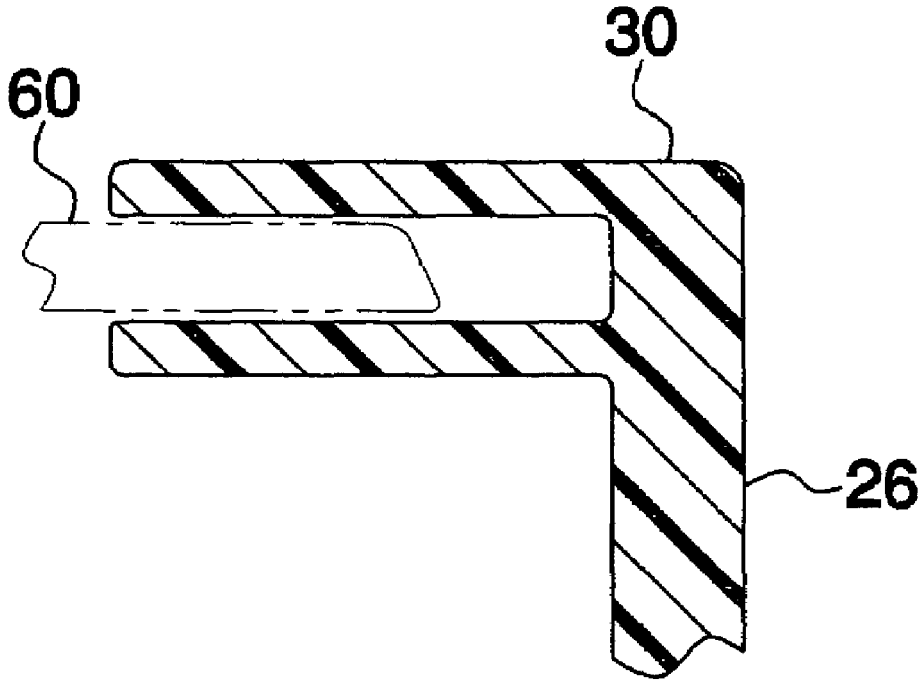
FIG. 4 is a cross sectional view of the actuation arm and fork of the invention of FIG. 1, taken along the line 4-4, the fork removably surrounding the toilet lid.

Referring to FIG. 1, the invention 10 comprises an apparatus for use proximal to either side of a toilet 50. The invention 10 comprises a parallelepiped base 12. The base 12 has a length and a width, the length having a front and a back. Optional feet 34 are disposed on the base. The parallelepiped foot pedal 14 has a length and a width. The width of the pedal 14 has a top and a bottom. The bottom of the pedal 14 is hingedly mounted to the front of the base 12 by hinge 16. At least one compression spring 36 between the pedal 14 and the base 12 resists downward pedal 14 movement, whereby the pedal 14 is returned to rest when released. The vertical stanchion 15 is disposed in an approximate center of the base 12. A plurality of pivot holes 17 is disposed in the vertical stanchion 15. The pivot arm 18 is removably and pivotally connected to the stanchion via pivot 24. The plurality of pivot holes 17 provide for adjustable location of the pivot arm 14. The pivot arm 14 has a first end, a second end, and a semicircular center 19. The approximate middle of the center 19 is pivotally connected to the vertical stanchion 15. The semicircular center 19 opens downwardly. The transverse 20 is affixed to the first end of the pivot arm 18. The riser 22 is affixed to the transverse 20. The riser 22 is pivotally connected to the pedal 14 proximate to the top of the pedal 14 at pivot 24. The actuation arm 26 has a bottom end, a top end, and a length. The bottom end of the actuation arm 26 is removably and pivotally connected to the second end of the pivot arm 18 at pivot 24 (FIGS. 2, 3, and 4). The top end of the actuation arm comprises a fork 30. The fork 30 is removably connected to the toilet lid 60. The actuation arm 26 is disconnected and reversed as needed for placement of the invention on either side of a toilet 50.

Referring to FIG. 2, the invention 10 is located proximal to one side of the toilet 50. The pedal 14 is not depressed. The lid 60 is therefore in the down position on the toilet 50. The actuation arm 26 has been adjustably connected to the stanchion 15. The pivot arm 18 has been adjustably connected to the stanchion 15. The actuation arm 26 is therefore in its lowest position, allowing the lid 60 to be closed.

Referring to FIG. 3, the foot pedal 14 is depressed. The pivot arm 18 has pivoted and raised the actuation arm 26. The fork 30 of the actuation arm 26 has lifted the toilet lid 60.

Referring to FIG. 4, the fork 30 of the actuation arm 26 slideably fits around a part of the side of the toilet lid 60. The provided movement of the fork around a part of the lid 60 insures that the mating of the fork 30 and lid 60 is not in a frictional bind.

With respect to the above description then, it is to be realized that the optimum dimensional relationships for the parts of the pivotally adjustable toilet lid lifting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pivotally adjustable toilet lid lifting and lowering apparatus, the apparatus for use proximal to either side of a toilet, the apparatus comprising:

a parallelepiped base, the base having length and a width, the length having a front and a back;

a parallelepiped foot pedal, the pedal having a length and a width, the width having a top and a bottom, the bottom of the pedal pivotally mounted to the front of the base;

a pedal resistance device resisting downward pedal movement, whereby the pedal is returned to rest when released;

a vertical stanchion disposed in an approximate center of the base;

a pivot arm pivotally connected to the stanchion, the arm having a first end, a second end, and a semicircular center, the approximate middle of the center connected to the stanchion;

the top of the pedal width pivotally connected to the first end of the pivot arm;

an actuation arm, the actuation arm having a bottom end, a top end, and a length, the bottom end removably and pivotally connected to the second end of the pivot arm, the top end removably connected to the toilet lid.

2. The invention in claim 1 wherein the actuation arm is further comprised of a fork, the fork for partially surrounding a side of the toilet lid.

3. The invention in claim 2 wherein the fork is attached perpendicularly to the top end of the actuation arm.

4. The invention in claim 1 wherein the bottom end of the pivot arm is further comprised of more than one harm hole, whereby pivot arm height is adjustable.

5. The invention in claim 2 wherein the bottom end of the pivot arm is further comprised of more than one harm hole, whereby pivot arm height is adjustable.

6. The invention in claim 3 wherein the bottom end of the pivot arm is further comprised of more than one harm hole, whereby pivot arm height is adjustable.

7. The invention in claim 1 wherein the pedal resistance device is at least one compression spring.

8. The invention in claim 2 wherein the pedal resistance device is at least one compression spring.

9. The invention in claim 3 wherein the pedal resistance device is at least one compression spring.

10. The invention in claim 4 wherein the pedal resistance device is at least one compression spring.

11. The invention in claim 5 wherein the pedal resistance device is at least one compression spring.

12. The invention in claim 6 wherein the pedal resistance device is at least one compression spring.

13. A pivotally adjustable toilet lid lifting and lowering apparatus, the apparatus for use proximal to either side of a toilet, the apparatus comprising:

a parallelepiped base, the base having length and a width, the length having a front and a back;

a parallelepiped foot pedal, the pedal having a length and a width, the width having a top and a bottom, the bottom of the pedal pivotally mounted to the front of the base;

at least one compression spring resisting downward pedal movement, whereby the pedal is returned to rest when released;

a vertical stanchion disposed in an approximate center of the base;

a plurality of pivot holes disposed in the vertical stanchion;

a pivot arm pivotally and removably connected to one of the pivot holes stanchion, the arm having a first end, a second end, and a semicircular center, the approximate middle of the center connected to the stanchion;

the top of the pedal width pivotally connected to the first end of the pivot arm;

an actuation arm, the actuation arm having a bottom end, a top end, and a length, the bottom end removably and pivotally connected to the second end of the pivot arm, the top end removably connected to the toilet lid, whereby the actuation arm is disconnected and reversed as need for placement of the invention on either side of a toilet.

14. The invention in claim 13 wherein the actuation arm is further comprised of a plurality of arm holes, whereby the height of the actuation arm is adjustable.

15. The invention in claim 13 wherein the base is further comprised of a plurality of feet on a bottom of the base.

16. A pivotally adjustable toilet lid lifting and lowering apparatus, the apparatus for use proximal to either side of a toilet, the apparatus comprising:

a parallelepiped base, the base having length and a width, the length having a front and a back;

a parallelepiped foot pedal, the pedal having a length and a width, the width having a top and a bottom, the bottom of the pedal pivotally mounted to the front of the base;

at least one compression spring resisting downward pedal movement, whereby the pedal is returned to rest when released;

a vertical stanchion disposed in an approximate center of the base;

a plurality of pivot holes disposed in the vertical stanchion;

a pivot arm having a first end, a second end, and a semicircular center, the approximate middle of the center pivotally connected to the vertical stanchion;

a transverse affixed to the first end of the pivot arm;

a riser affixed to the transverse, the riser pivotally connected proximal to the top of the pedal;

an actuation arm, the actuation arm having a bottom end, a top end, and a length, the bottom end removably and pivotally connected to the second end of the pivot arm, the top end removably connected to the toilet lid, whereby the actuation arm is disconnected and reversed as need for placement of the invention on either side of a toilet.

17. The invention in claim 16 wherein the actuation arm is further comprised of a plurality of arm holes, whereby the height of the actuation arm is adjustable.

18. The invention in claim 17 wherein the base is further comprised of a plurality of feet on a bottom of the base.

* * * * *